US006360519B1

(12) United States Patent
Hoover

(10) Patent No.: US 6,360,519 B1
(45) Date of Patent: Mar. 26, 2002

(54) APPARATUS AND METHODS FOR SPLICING SILVERS OF YARN DURING YARN FORMATION AND PROCESSING

(75) Inventor: Donald Lynn Hoover, Cramerton, NC (US)

(73) Assignee: American Linc Corporation, Gastonia, NC (US)

( * ) Notice: Subject to any disclaimer, the term of this patent is extended or adjusted under 35 U.S.C. 154(b) by 0 days.

(21) Appl. No.: 09/782,710

(22) Filed: Feb. 13, 2001

(51) Int. Cl.[7] ..... D01H 17/00
(52) U.S. Cl. ..... 57/22; 57/23
(58) Field of Search ..... 57/22, 23, 202, 57/261, 263; 19/144, 150, 157, 159 A, 159 R; 28/141, 254, 271, 272

(56) References Cited

U.S. PATENT DOCUMENTS

| | | | | |
|---|---|---|---|---|
| 2,608,725 A | | 9/1952 | Strew | 19/157 |
| 3,308,520 A | | 3/1967 | Gagnon | 28/72.2 |
| 3,633,352 A | | 1/1972 | Marriner | 57/22 |
| 3,643,417 A | * | 2/1972 | Irwin | 57/22 |
| 3,654,755 A | * | 4/1972 | Bell | 57/23 |
| 4,018,039 A | * | 4/1977 | Leeper | 57/23 |
| 4,445,318 A | | 5/1984 | Becker et al. | 57/22 |
| 4,457,128 A | * | 7/1984 | Brunvoll | 57/23 |
| 4,969,323 A | | 11/1990 | Stahlecker | 57/261 |
| 4,982,563 A | | 1/1991 | Stahlecker | 57/261 |
| 5,058,241 A | | 10/1991 | Haigh et al. | 19/150 |
| 5,140,722 A | | 8/1992 | Akiyama | 19/150 |
| 5,175,982 A | | 1/1993 | Stahlecker | 57/22 |
| 5,357,740 A | * | 10/1994 | Moreland | 57/22 |
| 5,359,758 A | | 11/1994 | Stahlecker et al. | 28/117 |
| 5,488,758 A | | 2/1996 | Tahara et al. | 19/150 |
| 5,544,389 A | | 8/1996 | Onoue et al. | 19/157 |
| 5,551,134 A | | 9/1996 | Fehrer | 28/115 |
| 5,765,352 A | | 6/1998 | McRae | 57/22 |
| 6,065,191 A | | 5/2000 | Leifeld | 19/159 |

FOREIGN PATENT DOCUMENTS

| | | |
|---|---|---|
| DE | 0275658 | 1/1990 |
| DE | 4236503 | 5/1994 |
| GB | 334295 | 9/1930 |
| JP | 406316825 A | 11/1994 |

OTHER PUBLICATIONS

German pages from Art/Textbook (date unknown), English Translation.

* cited by examiner

*Primary Examiner*—John J. Calvert
*Assistant Examiner*—Gary L. Welch
(74) *Attorney, Agent, or Firm*—Allen, Dyer, Doppelt, Milbrath & Gilchrist, P.A.

(57) ABSTRACT

An apparatus and methods are provided for splicing selected portions of sliver such as during yarn formation and processing. The apparatus preferably includes a needle carrying member having a plurality of needles to engage sliver when positioned adjacent thereto and a needle engaging member positioned to underlie the needle carrying member and to receive the plurality of needles from the first needle carrying member. The apparatus also preferably includes a hand-activated needle actuation device connected to the needle carrying member and the needle engaging member to position the needle carrying member in an open position to allow sliver to be spliced to be readily positioned therebetween and responsive to closing at least portions of the hand of a user for actuating the engaging of the needle carrying member with the sliver and the needle engaging member so that the engaging of plurality of needles of the needle carrying member with the needle engaging member thereby defines a closed position.

37 Claims, 8 Drawing Sheets

20

50
30
32
32
50
43
40
42
45

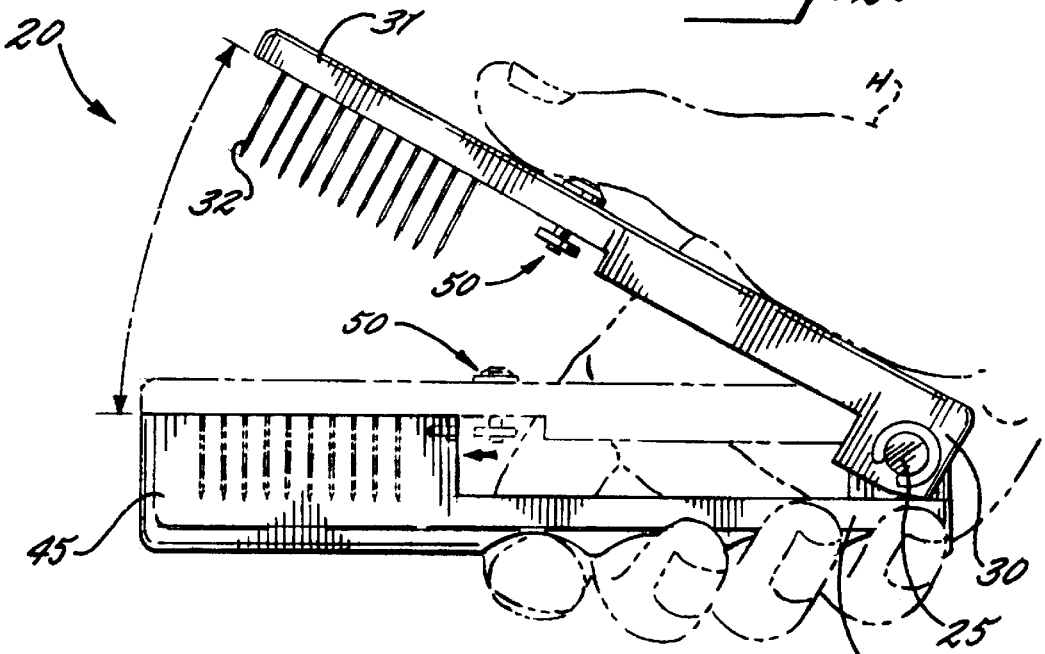
Fig. 2.
Fig. 4.
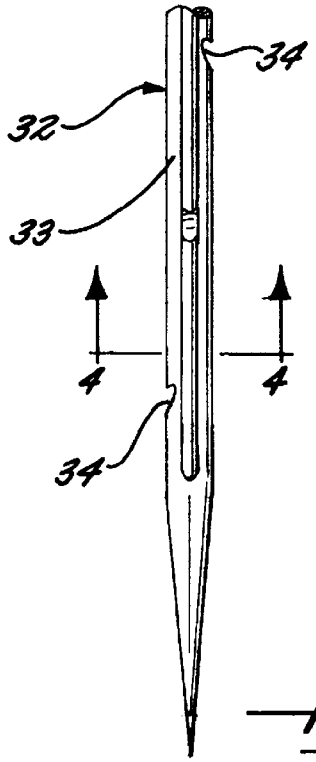
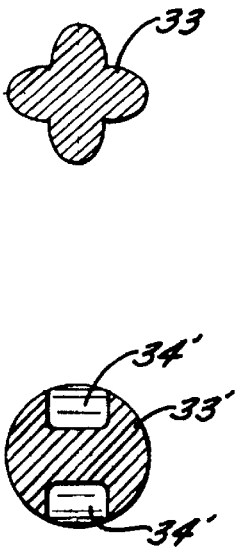
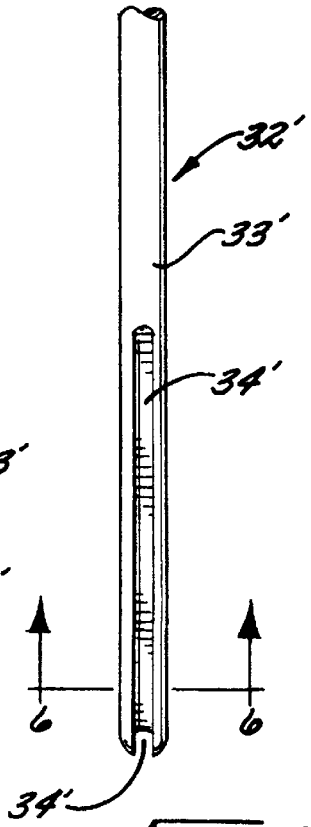
Fig. 6.
Fig. 3.
Fig. 5.

APPARATUS AND METHODS FOR SPLICING SILVERS OF YARN DURING YARN FORMATION AND PROCESSING

FIELD OF THE INVENTION

The present invention relates to the textile industry and, more particularly, to the field of textile splicing and methods.

BACKGROUND OF THE INVENTION

In the textile industry, yarn is formed of a plurality of slivers. To form the yarn, however, various steps are required to obtain the type and texture of the yarn desired. During sliver processing, sliver is often provided for shipment and use in cans or other containers which allow a first end of the sliver to be drawn or pulled from the can. A second end of the sliver is often left available for splicing to the first end of another can. This splicing is conventionally accomplished by a hand-type braid, twist, or other connection between the second end of the first can and the first end of the second can to join these respective ends of sliver together so that when the first can of sliver empties, the second can is ready to go for additional sliver processing. This hand-type braiding or twisting of the sliver has also become somewhat of a specialty of different textile personnel in sliver handling and processing. This manual procedure, however, can be time consuming, labor intensive, costly, inconsistent from person to person forming the braid or twist, and often is not strong or secure enough when the sliver is further handled or processed.

Other types of automatic splicing systems have been developed over the years. Examples can be seen in U.S. Pat. No. 5,544,389 by Onoue et al. titled "Sliver Piecing In Spinning Machines," U.S. Pat. No. 5,140,722 by Akiyama titled "Sliver Piecing Device Having Fiber Entangling Needles And Air Jets," U.S. Pat. No. 5,058,241 by Haigh et al. titled "Method And Apparatus For Combining Fibres Formed Into Slivers For Supply To Textile Machinery," U.S. Pat. No. 4,445,318 by Becker et al. titled "Method And Device For Making A Knot-Free Thread Connection By Splicing," U.S. Pat. Nos. 4,969,323 and 4,982,563 each by Stahlecker and each titled "Sliver Splicing Arrangement For A Spinning Machine," U.S. Pat. No. 2,608,725 by Strew titled "Sliver Piecing Device," U.S. Pat. No. 3,308,520 by Gagnon titled "Process Of Splicing Tow," U.S. Pat. No. 5,359,758 by Stahlecker et al. titled "Process And An Arrangement For The Piercing Of A Sliver," Japanese Patent Document Application No. 05105652 by Takashi titled "Sliver Joining Apparatus In Spinning Machine," and German Patent Document No. 90-210593/28 titled "Automatic Splicer For Roving On Ring-Spinning Frame—Has Needle Arrangement To Felt Fibres." These automated systems, however, can be quite expensive to install, can be costly to operate, can have various complex mechanical and/or electrical problems, can take up additional floor space in manufacturing environments, can be bulky and awkward to use, and can often require extensive special training for personnel or the hiring of special personnel to oversee this automated equipment.

SUMMARY OF THE INVENTION

With the foregoing in mind, the present invention advantageously provides an apparatus and methods for splicing slivers of yarn during formation and processing which is compact, relatively simple to use, and readily portable. The present invention also advantageously provides an apparatus and methods for splicing various types of textile slivers which is relatively inexpensive and does not require extensive personnel training to understand and operate. The present invention additionally advantageously provides an apparatus and methods for splicing various types of textile sliver which allows the user to easily handle, carry, and tote and which is of such a size as to be easily inserted into a pocket of a garment or a carrying case worn by the user. The present invention still also advantageously provides an apparatus and methods for splicing textile sliver which forms a substantially secure connection between ends of sliver being spliced or joined for later handling and/or processing. The present invention further advantageously provides an apparatus and methods for splicing textile sliver which is less complex, easy to repair or replace parts, and is readily adaptable to various splicing needs and situations.

More particularly, the present invention provides an apparatus for splicing selected portions of sliver which preferably includes a needle carrying member having a plurality of needles to engage sliver when positioned adjacent thereto, a needle engaging member positioned to receive the plurality of needles from the first needle carrying member when the plurality of needles engage the sliver in a closed position, and a hand-activated needle actuation device connected to the needle carrying member and the needle engaging member to position the needle carrying member in an open position so that the plurality of needles is spaced-apart from the needle engaging member to allow sliver to be spliced to be readily positioned therebetween and responsive to grippingly closing at least portions of the hand of a user to actuate the engaging of the needle carrying member with the sliver and the needle engaging member when the sliver is positioned between the needle carrying member and the needle engaging member so that the engaging of plurality of needles of the needle carrying member with the needle engaging member thereby defines a closed position.

The present invention also advantageously provides an apparatus for splicing sliver which preferably includes a first handle portion having at least one sliver engaging member, a second handle portion positioned to receive the at least one sliver engaging member in a closed position, and a pivot member associated with the first and second handle portions to allow either the first or second handle portions to pivot about the pivot member between respective open and closed positions. The open position preferably is defined by portions of the first handle member having the at least one sliver engaging member being spaced-apart from portions of the second handle portion positioned to receive the at least one sliver engaging member, and the closed position preferably is defined by the at least one sliver engaging member of the first handle portion being received by the portions of the second handle member when positioned closely adjacent thereto. The apparatus preferably further includes a biasing member associated with the pivot member and positioned to bias either the first or the second handle portions in a preselected biased position.

The present invention additionally provides an apparatus for splicing sliver which preferably includes a first handle portion having a first handle body and at least one sliver engaging member detachably connected to the first handle body to thereby define a cartridge member, a second handle portion pivotally connected to and positioned to receive the at least one sliver engaging member and pivot between open and closed positions. The open position is preferably defined by the at least one sliver engaging member being spaced-apart from portions of the second handle portion positioned to receive the at least one sliver engaging member, and the closed position preferably is defined by the at least one sliver engaging member of the first handle portion being received by the portions of the second handle member when positioned closely adjacent thereto. The apparatus preferably also includes a biasing member positioned to bias either the first or the second handle portions in a preselected biased position.

The present invention further provides methods of splicing sliver. A first method preferably includes grippingly closing a handle portion of a sliver splicer having at least one sliver engaging member by the hand of a user so that the at least one sliver engaging member engages and splices sliver positioned adjacent thereto and releasingly opening the handle portion by the hand of the user to thereby release the spliced portion of sliver from the at least one sliver engaging member.

Another method of splicing sliver, according to the present invention, preferably includes closing a handle portion of a needle engaging member having a plurality of needles so that the plurality of needles engages and splices sliver positioned adjacent thereto and opening the handle portion of the needle engaging member so that the plurality of needles release the spliced portions of sliver therefrom.

Yet another method of splicing sliver according to the present invention preferably includes joining first portions of sliver with a plurality of needles each having a recessed portion to engage and intertwine with adjacent second portions of sliver, the plurality of needles being connected to a body portion so that the body portion and the plurality of needles in combination define a needle cartridge member and replacing the needle cartridge member with an auxiliary cartridge member also having a body portion and a plurality of needles connected to the body portion.

The apparatus and methods of the present invention provide additional manufacturing, handling, processing, and formation flexibility in the use of the splicers for sliver. For example, manufacturing personnel can walk around a facility with an apparatus of the present invention positioned in a pocket, holster, or harness when the splicing apparatus or splicer is preferably in a locked closed position so that the manufacturing personnel can readily remove the splicer, unlock the splicer, accomplish the splicing function, relock the splicer, and return the splicer to the pocket, holster, or harness. Additionally, the splicing apparatus of the present invention can be strapped to a chain or belt which can enhance carrying and portability. Further, when one or more needles or other sliver engaging members are damaged, according to one embodiment of the present invention, a cartridge member can readily be removed which carries the needles and replaced with an auxiliary cartridge member. This cartridge replacement, for example, prevents the need to replace the entire splicing apparatus and saves money and reordering time. Also, because the splicing apparatus is portable, compact, and relatively of simple construction and low cost, many different types of manufacturing personnel can use the splicing apparatus and can readily order additional or readily replace the entire splicing apparatus if desired without incurring extensive costs.

BRIEF DESCRIPTION OF THE DRAWINGS

Some of the features, advantages, and benefits of the present invention having been stated, others will become apparent as the description proceeds when taken in conjunction with the accompanying drawings in which:

FIG. 2 is a side elevational view of an apparatus for splicing sliver being actuated by the hand of a user according to a first embodiment of the present invention;

FIG. 3 is an enlarged fragmentary elevational view of a type of needle of an apparatus for splicing sliver according to the present invention;

FIG. 4 is a sectional view of a needle of an apparatus for splicing sliver taken along line 4—4 of FIG. 3 according to the present invention;

FIG. 5 is an enlarged fragmentary elevational view of a needle of an apparatus for splicing sliver according to the present invention;

FIG. 6 is a sectional view of a needle of an apparatus for splicing sliver taken along line 6—6 of FIG. 5 according to the present invention;

DETAILED DESCRIPTION OF PREFERRED EMBODIMENTS

Figure 1:
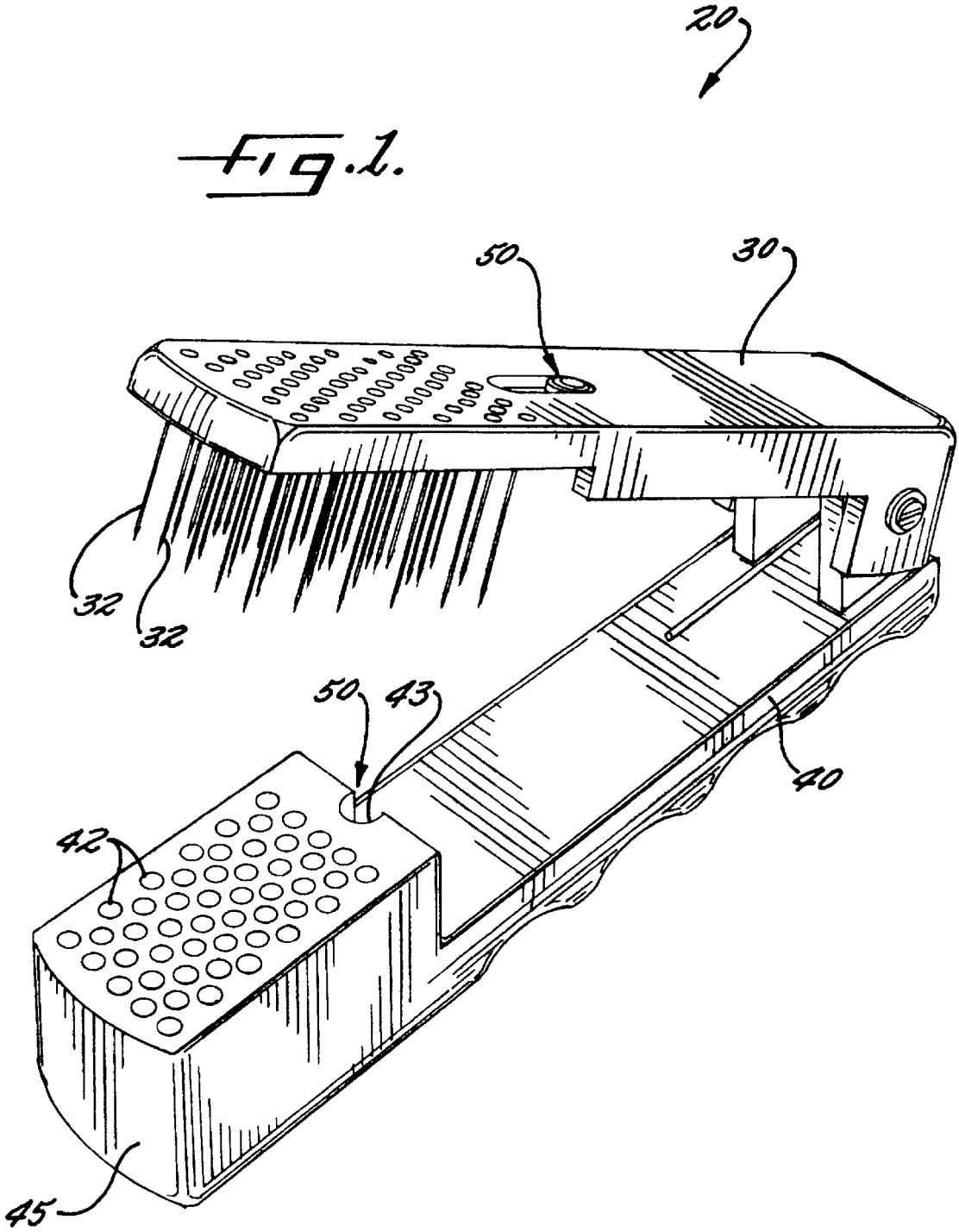
FIG. 1 is a perspective view of an apparatus for splicing sliver according to a first embodiment of the present invention.
Figure 7A:
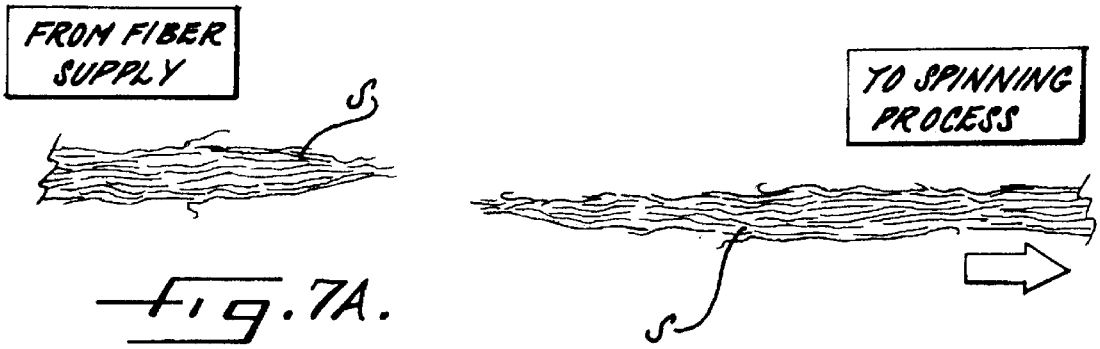
FIGS. 7A–7D are schematic perspective views of the operation of an apparatus for splicing sliver according to a first embodiment of the present invention.
Figure 7B:
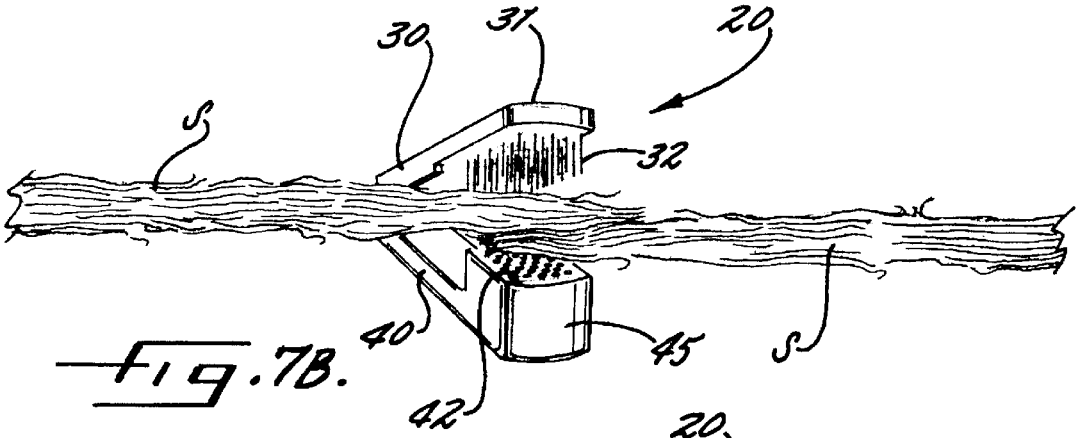
Figure 7C:
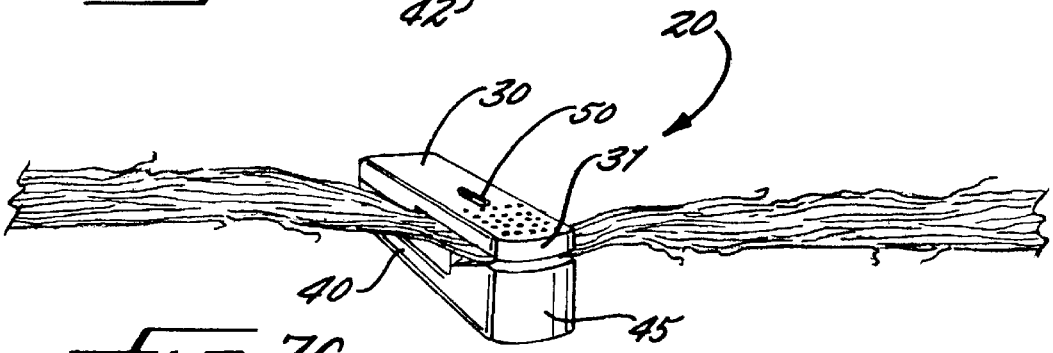
Figure 7D:
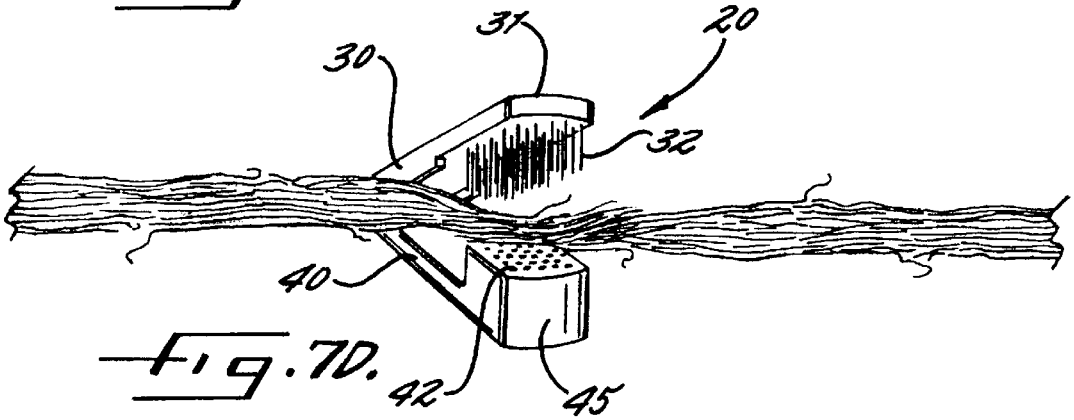
Figures 8A, 8B:
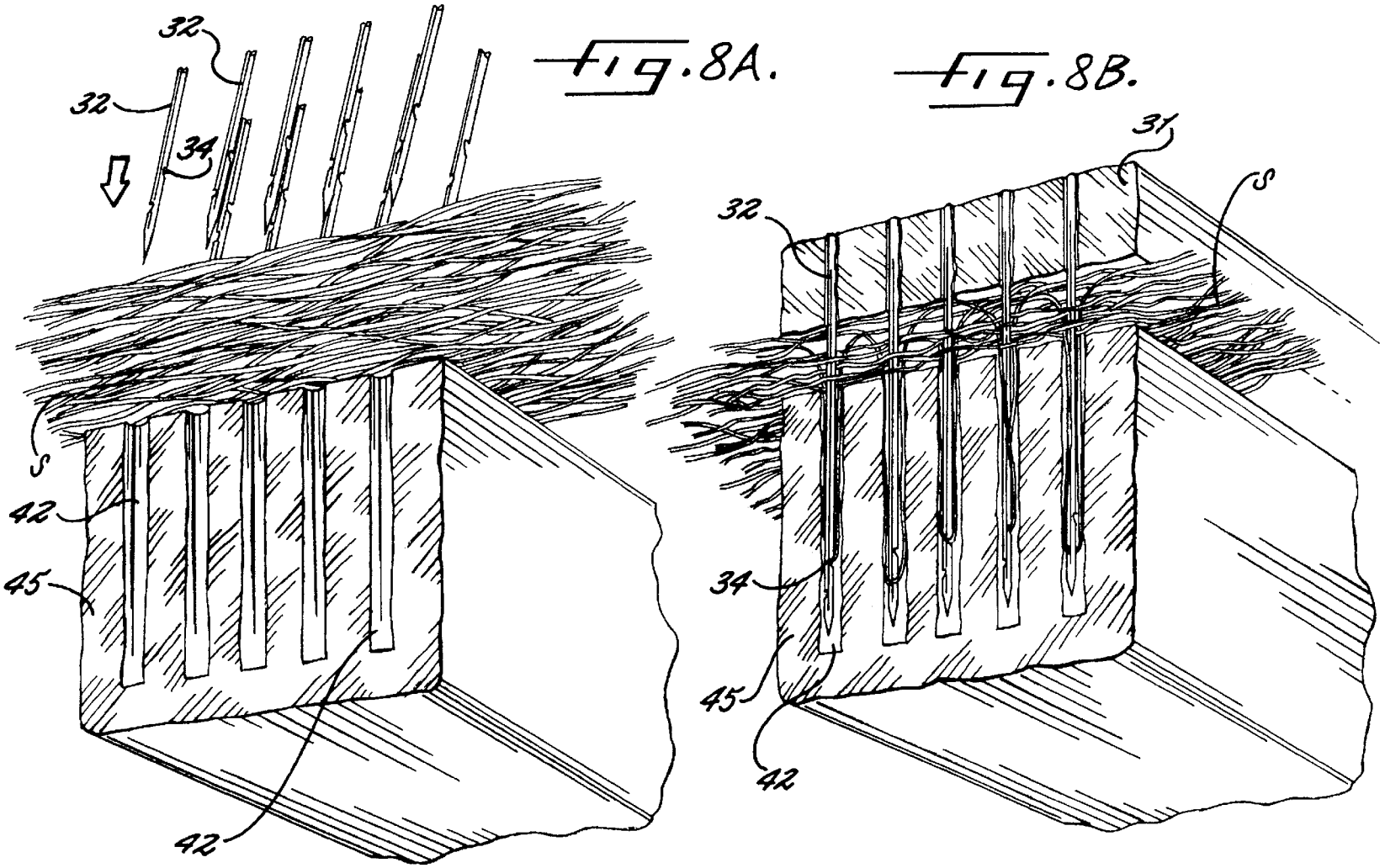
FIG. 8A is an enlarged fragmentary perspective view of an apparatus for splicing sliver prior to engagement with sliver in an open position according to the present invention.
FIG. 8B is an enlarged fragmentary perspective view of an apparatus for splicing sliver after engagement with the sliver in a closed position according to the present invention.
Figure 9:
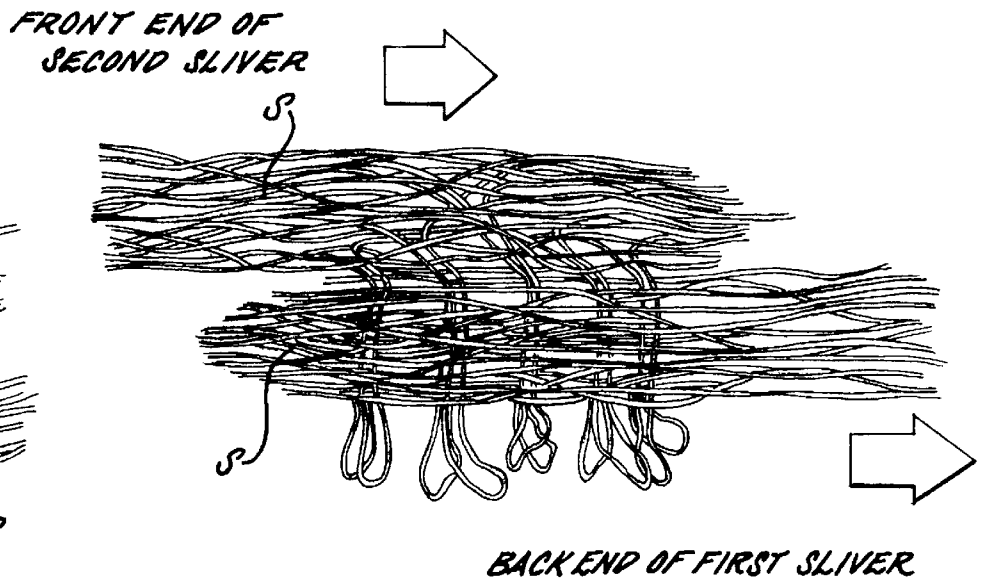
FIG. 9 is an enlarged fragmentary view of sliver after being spliced with an apparatus for splicing sliver according to the present invention.
Figure 8C:
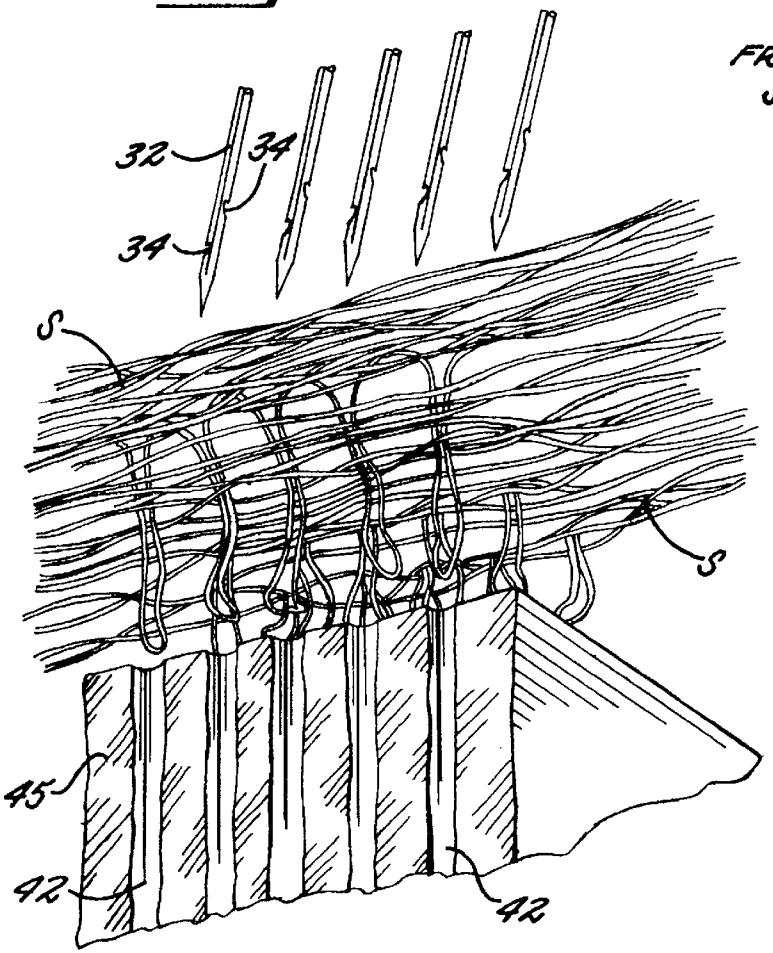
FIG. 8C is an enlarged fragmentary perspective view of an apparatus for splicing sliver after engagement with the sliver in an open position according to the present invention.

The present invention will now be described more fully hereinafter with reference to the accompanying drawings which illustrate preferred embodiments of the invention. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, the prime notation, if used, indicates similar elements in alternative embodiments.

FIGS. 1–9 illustrate a first embodiment of an apparatus 20 for splicing sliver S. The apparatus 20 preferably includes a first handle portion 30 having at least one sliver engaging member. The at least one sliver engaging member is preferably one or more needles 32, and more preferably a plurality of needles 32, connected to the first handle portion 30. A second handle portion 40 preferably is positioned to receive the at least one sliver engaging member, e.g., the plurality of needles 32, in a closed position such as through or within one or more openings or bores 42, 42' as shown (see also FIG. 10). As perhaps be shown in FIGS. 1–2 and 14, a pivot member 25 is associated with, and preferably connected to or mounted as illustrated, to the first and second handle portions 30, 40 to allow either the first or second handle portions 30, 40 to pivot about the pivot member 25 between respective open and closed positions. The open position preferably is defined by distal portions 31 of the first handle portion 30 having the at least one sliver engaging member being spaced-apart from distal portions 31 of the second handle portion 40 positioned to receive the at least one sliver engaging member, and the closed position preferably is defined by the at least one sliver engaging member of the first handle portion 30 being received by the distal portions of the second handle portion 40 when positioned closely adjacent thereto.

Figures 10, 11:
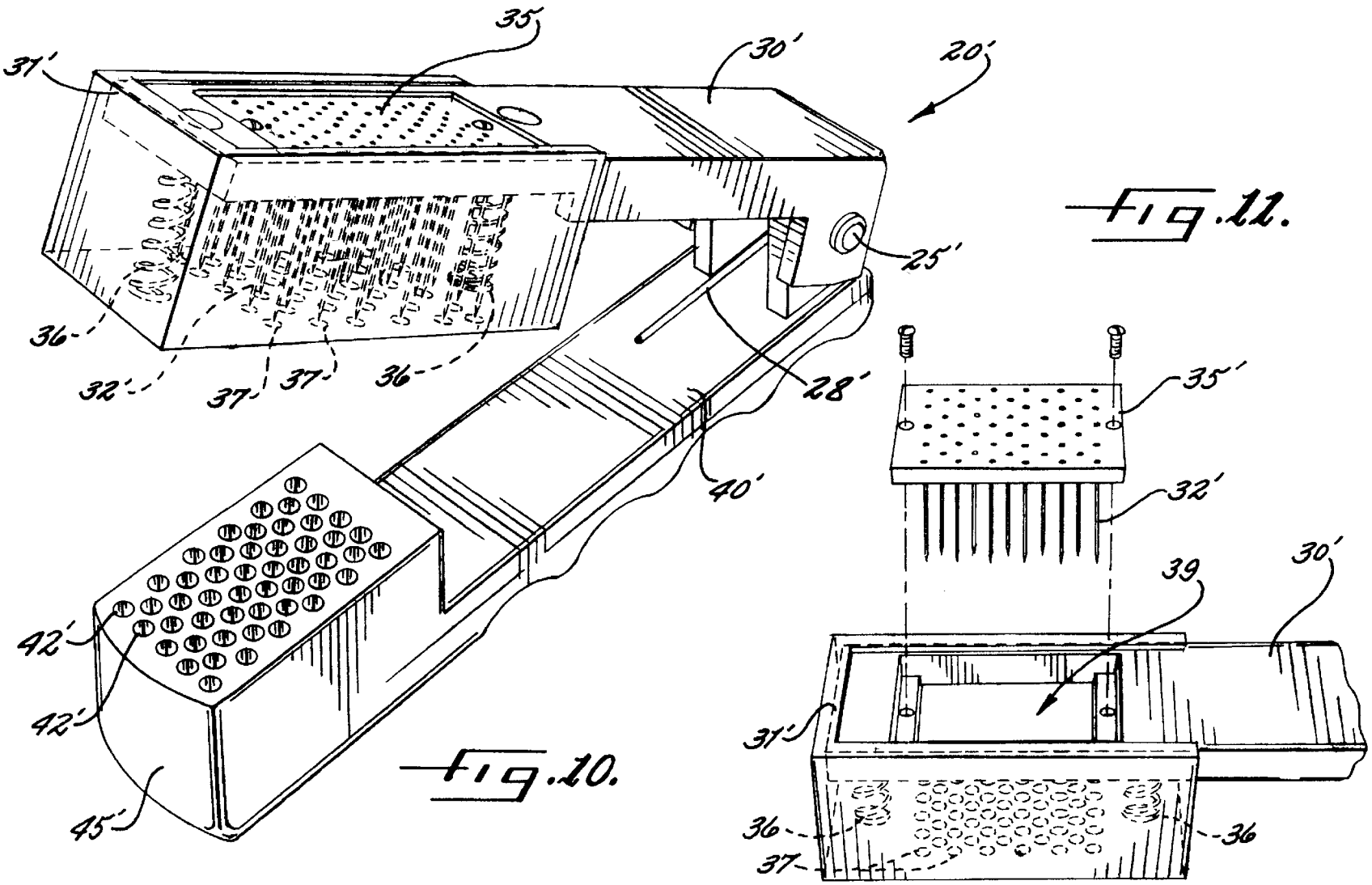
FIG. 10 is a perspective view of an apparatus for splicing sliver according to a second embodiment of the present invention.
FIG. 11 is an exploded fragmentary perspective view of a needle cartridge for positioning in an apparatus for splicing sliver according to a second embodiment of the present invention.
Figure 12:
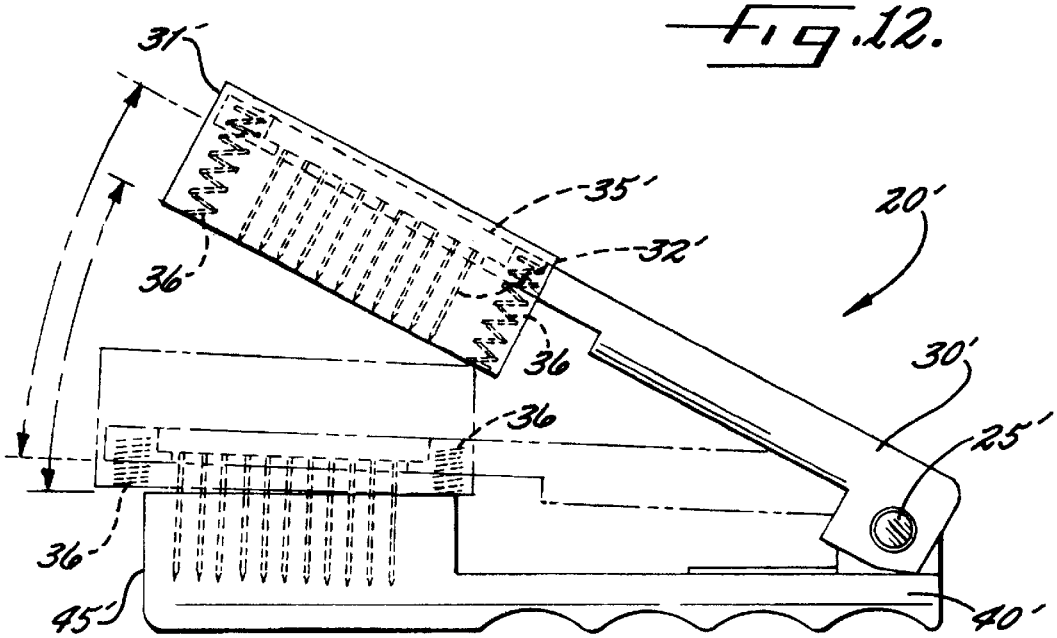
FIG. 12 is a side elevational view of an apparatus for splicing sliver having a needle cartridge illustrated by broken lines for clarity according to a second embodiment of the present invention.
Figure 13:
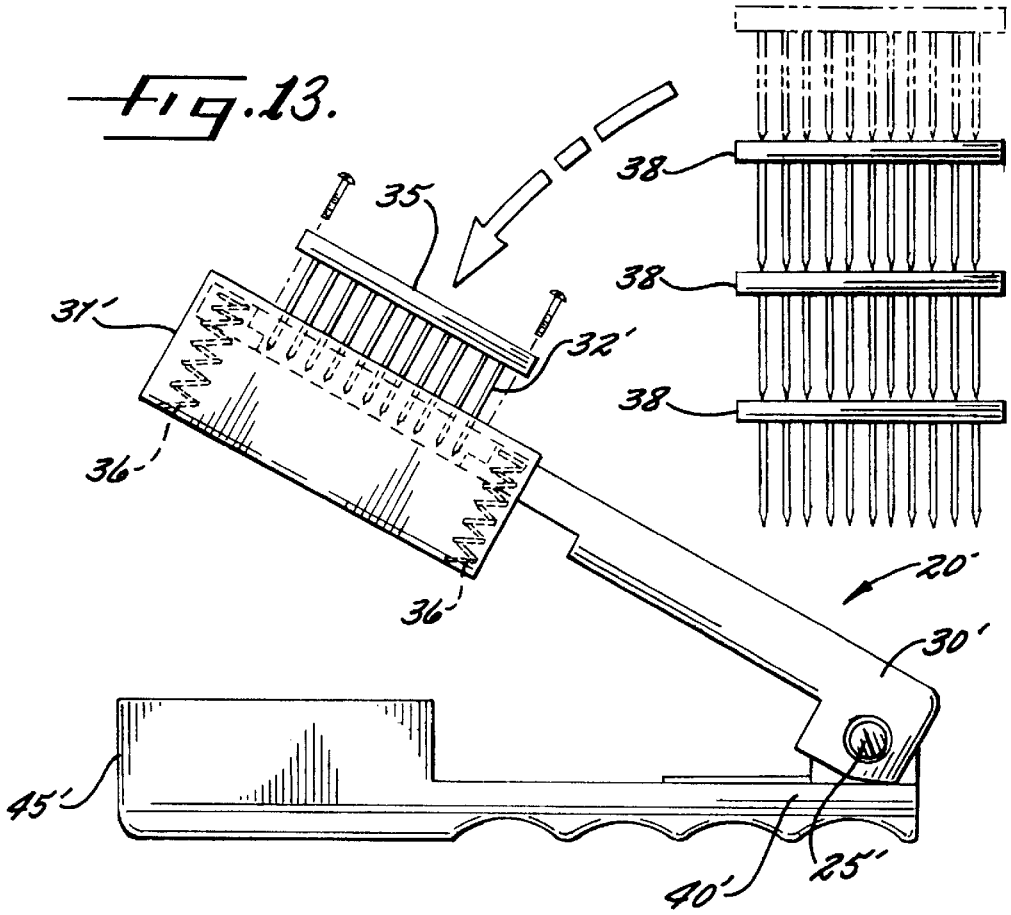
FIG. 13 is an exploded side elevational view of an apparatus for splicing sliver having a needle cartridge member and a plurality of replacement auxiliary needle cartridge members according to a second embodiment of the present invention.
Figure 14:
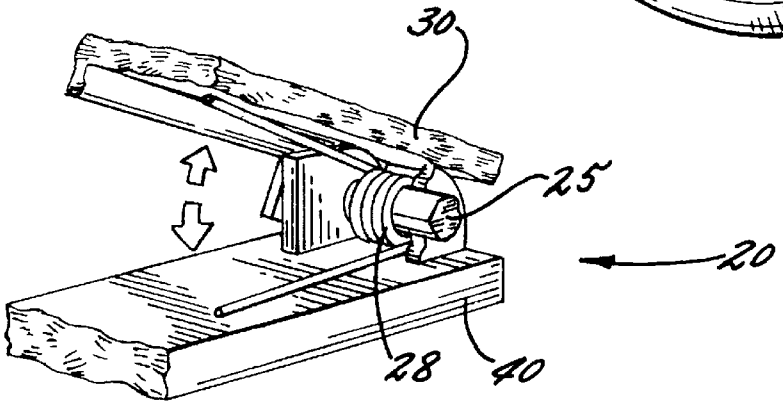
FIG. 14 is a fragmentary perspective view a portion of an apparatus for splicing sliver illustrating a connection between first and second handle portions along a pivot member and the position of a biasing member to bias the apparatus in an open position according to the present invention.

The apparatus 20 preferably includes a biasing member 28, 28' associated with the pivot member 25, 25' and positioned to bias either the first or the second handle portions 30, 40 in a preselected biased position (see also FIGS. 10 and 12–13). In the embodiment of the splicing apparatus 20 as illustrated, the first handle portion 30 is biased by the biasing member 28 to the open position. As shown in FIG. 14, the biasing member 28 is preferably a spring as understood by those skilled in the art and preferably is connected to the pivot member 25 and positioned to bias the first handle portion 30 in the open position. Other types of biasing members, including various types of springs, can be used as well. Although the illustrated embodiment of biasing the first handle portion 30 in the open position is particularly advantageous due to the movement desired in the splicing process and the ease of use by a user's hand, for example, it will also be understood by those skilled in the art that the present invention would include biasing the splicing apparatus 20" in the closed position (see also FIG. 15). Further, the apparatus 20 preferably also includes a lock 50 associated with the first and second handle portions 30, 40 to lock the first and second handle portions 30, 40 in a closed position. In the embodiment shown, the lock 50 is primarily connected to the first handle portion 30 and slidably engages or locks, e.g., a latch, with the second handle portion 40, e.g., into a slot or channel 43 by connecting to the needle receiving portion or body 45 of the second handle portion 40 (see FIG. 2).

As perhaps best illustrated in FIG. 2, the first and second handle portions 30, 40 define a hand-activated needle actuation device which advantageously allows a ready grip by a user's hand H to apply pressure from the user's hand H to actuate the movement of the plurality of needles 32. As described above, and as illustrated in FIGS. 7A–7D and 8A–8C, the at least one sliver engaging member preferably includes a plurality of needles 32, and the hand-activated needle actuation device is responsive to grippingly closing at least portions of the hand H of a user to actuate the engaging of the plurality of needles 32 with the sliver S to be spliced and the distal portions 45, e.g., through the openings or bores 42, 42' of the second handle portion 40 when the sliver S is positioned between the plurality of needles 32 and the distal portions 45 of the second handle portion 40 so that the engaging of plurality of needles 32 with the distal portions 45 of the second handle portion 40 thereby further defines the closed position (see also FIG. 10).

Also, as perhaps best shown in FIGS. 3–6 and 8A–8C, each of the plurality of needles 32 preferably includes a needle body 33, 33' and a recessed portion 34, 34' formed in the needle body 33, 33' and positioned to assist in the engaging of and interconnecting of the sliver S when each needle 32, 32' engages sliver S during movement to the closed position. The recessed portion 34, 34' preferably includes at least one of the following: a barb, a groove, and a channel. The recessed portion 34, 34' preferably has an upward slope with respect to the downward movement of the needle 32 so that the recessed portion 34, 34' readily catches, engages, or otherwise contacts the sliver S during the downward motion of the needles and responsively releases the sliver S during upward motion. This process allows the intertwining or interconnecting of the sliver S to join the portions of sliver S desired to be spliced together.

As shown in FIGS. 10–13 and 15, according to a second embodiment of a splicing apparatus 20' of the present invention, the at least one sliver engaging member preferably is detachably connected to the first handle portion 30' and defines a cartridge member 35, 35' positioned in distal portions 31' of the first handle portion 30' to readily remove from the first handle portion 30'. At least one replacement auxiliary cartridge member 38, and preferably a plurality of replacement auxiliary cartridge members 38, can have the same construction as the cartridge member 35, 35' and can be adapted to be readily positioned in the first handle portion 30'. Accordingly, a kit can also be provided which has a portable splicing apparatus 20' positioned in a container, e.g., box, bag, package, with one or more auxiliary cartridge members 38, so that when a cartridge member 35, 35' being used is damaged, dulled, or otherwise desired to be replaced, another cartridge member 38 can be readily inserted into an opening 39 in the first handle portion 30' of the splicing apparatus 20' after removal of the damaged cartridge member 35, 35' so that splicing operations proceed with substantially reduced interruptions. The distal portion 45' of the second handle portion 40' preferably has additional springs or other types of biasing members 36 which allow the needles 32' to retract and extend from openings 37 in the distal portion 31' as shown.

Figure 15:
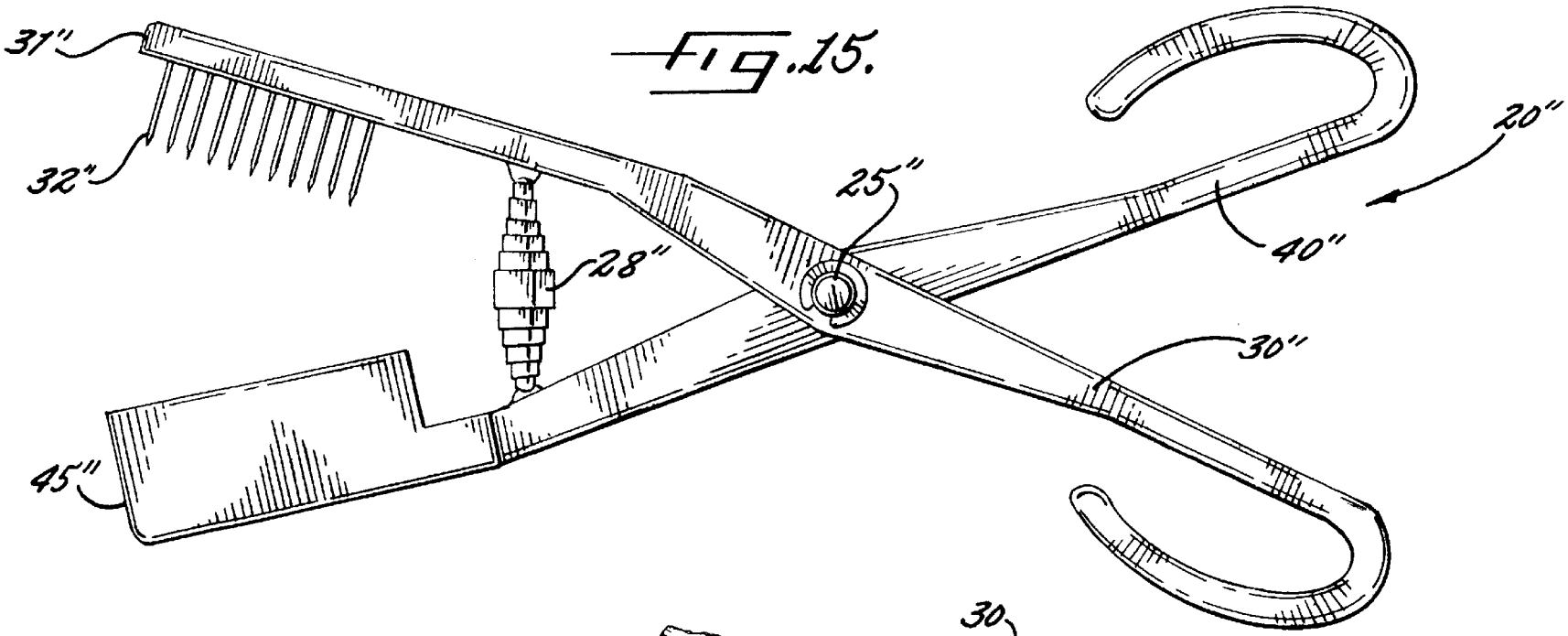
FIG. 15 is an apparatus for splicing sliver according to a third embodiment of the present invention.

Further still, as shown in FIG. 15, scissor-type handles 30", 40", substantially closed loops, and various other types of handle or finger grips can also be used. In this embodiment of a splicing apparatus 20", the pivot member 25" is also moved forward toward a more medial portion of the handle members 30", 40" and the biasing member 28" is another type of spring, as understood by those skilled in the art, which biases the scissor-type handle embodiment to a closed position so that the distal portions 31", 45" of the handles are positioned closely adjacent each other and the plurality of needles 32" can engage receiving portions of the handle 40".

As illustrated in FIGS. 1–15, the present invention further provides methods of splicing sliver S. A first method preferably includes grippingly closing a handle portion 30 of a sliver splicer 20 having at least one sliver engaging member 32 by the hand H of a user so that the at least one sliver engaging member 32 engages and splices sliver S positioned adjacent thereto and releasingly opening the handle portion 30 by the hand H of the user to thereby release the spliced portion of sliver S from the at least one sliver engaging member 32.

Another method of splicing sliver S according to the present invention preferably includes closing a handle portion 30 of a needle engaging member having a plurality of needles 32 so that the plurality of needles 32 engages and splices sliver S positioned adjacent thereto and opening the handle portion 30 of the needle engaging member so that the plurality of needles 32 release the spliced portions of sliver S therefrom.

Yet another method of splicing sliver S according to the present invention preferably includes joining first portions of sliver S with a plurality of needles 32 each having a recessed portion 34 to engage and intertwine with adjacent second portions of sliver S. The plurality of needles preferably is connected to a body portion so that the body portion and the plurality of needles 32 in combination define a needle cartridge member 35 and replacing the needle cartridge member 35 with an auxiliary cartridge member 38 also having a body portion and a plurality of needles 32 connected to the body portion.

The apparatus 20, 20', 20" and methods of the present invention provide additional manufacturing, handling, processing, and formation flexibility in the use of the splicers for sliver. For example, manufacturing personnel can walk around a facility with an apparatus 20 of the present invention positioned in a pocket, holster, or harness when the splicing apparatus 20 or splicer is preferably in a locked closed position so that the manufacturing personnel can readily remove the splicer 20, unlock the splicer 20, accomplish the splicing function, relock the splicer 20, and return the splicer 20 to the pocket, holster, or harness. Additionally, the splicing apparatus 20 of the present invention can be strapped to a chain or belt which can enhance carrying and portability. Further, when one or more needles 32 or other sliver engaging members are damaged, according to one embodiment of the present invention, a cartridge member 35 can readily be removed which carries the needles 32' and replaced with an auxiliary cartridge member 38. This cartridge replacement, for example, prevents the need to replace the entire splicing apparatus 20' and saves money and reordering time. Also, because the splicing apparatus 20 is portable, compact, and relatively of simple construction and low cost, many different types of manufacturing personnel can use the splicing apparatus 20, 20', 20" and can readily order additional or readily replace the entire splicing apparatus 20, 20', 20" if desired without incurring extensive costs.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That claimed is:

1. An apparatus for splicing selected portions of sliver, the apparatus comprising:

a needle carrying member having a plurality of needles to engage sliver when positioned adjacent thereto;

a needle engaging member positioned to receive the plurality of needles from the needle carrying member when the plurality of needles engage the sliver in a closed position; and a hand-activated needle actuation device connected to the needle carrying member and the needle engaging member to position the needle carrying member in an open position so that the plurality of needles is spaced-apart from the needle engaging member to allow sliver to be spliced to be readily positioned therebetween and responsive to grippingly closing at least portions of the hand of a user to actuate the engaging of the needle carrying member with the sliver and the needle engaging member when the sliver is positioned between the needle carrying member and the needle engaging member so that the engaging of plurality of needles of the needle carrying member with the needle engaging member thereby defines a closed position.

2. An apparatus as defined in claim 1, wherein the hand-activated needle actuation device includes a first handle portion connected to the needle carrying member, a second handle portion connected to the needle engaging member, and a pivot member connected to the first and second handle portions to allow either the first or second handle portions to pivot about the pivot member between the respective open and closed positions.

3. An apparatus as defined in claim 2, wherein the hand-activated needle actuation device further includes a biasing member associated with the pivot member and positioned to bias the needle carrying member in the open position.

4. An apparatus as defined in claim 3, wherein the needle engaging member includes a body member and a plurality of openings formed in the body member, the number of the plurality of openings being equal to the number of the plurality of needles, each of the plurality of openings being positioned to underlie a corresponding one of the plurality of needles of the needle carrying member so that the plurality of openings matingly receive the plurality of needles as the plurality of needles pass into and out of the plurality of openings to thereby engage the needles and sliver being carried therewith.

5. An apparatus as defined in claim 4, wherein the body member of the needle engaging member includes a substantially closed bottom, and wherein the bottom underlies each of the plurality of openings so that portions of the bottom define a floor for each of the plurality of openings.

6. An apparatus as defined in claim 5, further comprising at least one replacement auxiliary needle cartridge adapted to be readily positioned in the first handle portion.

7. An apparatus as defined in claim 2, wherein the needle carrying member is detachably connected to the first handle portion and defines a needle cartridge to readily remove from the first handle portion.

8. An apparatus as defined in claim 1, wherein each of the plurality of needles includes a needle body and a recessed portion formed in the needle body and positioned to assist in the engaging of and interconnecting of the sliver when each needle engages sliver during movement to the closed position.

9. An apparatus as defined in claim 8, wherein the recessed portion includes at least one of the following: a barb, a groove, and a channel.

10. An apparatus for splicing selected portions of sliver, the apparatus comprising:

a needle carrying member having a plurality of needles to engage sliver when positioned adjacent thereto;

a needle engaging member positioned to underlie the needle carrying member and to receive the plurality of needles from the first needle carrying member; and hand-activated needle actuation means connected to the needle carrying member and the needle engaging member to position the needle carrying member in an open position to allow sliver to be spliced to be readily positioned therebetween and responsive to closing at least portions of the hand of a user for actuating the engaging of the needle carrying member with the sliver and the needle engaging member so that the engaging of plurality of needles of the needle carrying member with the needle engaging member thereby defines a closed position.

11. An apparatus as defined in claim 10, wherein the hand-activated needle actuation means includes a first handle portion connected to the needle carrying member, a second handle portion connected to the needle engaging member, and a pivot member connected to the first and second handle portions to allow either the first or second handle portions to pivot about the pivot member between the respective open and closed positions.

12. An apparatus as defined in claim 11, wherein the hand-activated needle actuation means further includes a biasing member associated with the pivot member and positioned to bias the needle carrying member in the open position.

13. An apparatus as defined in claim 12, wherein each of the plurality of needles includes a needle body and a recessed portion formed in the needle body and positioned to assist in the engaging of and interconnecting of the sliver when each needle engages sliver during movement to the closed position.

14. An apparatus as defined in claim 13, wherein the recessed portion includes at least one of the following: a barb, a groove, and a channel.

15. An apparatus as defined in claim 13, wherein the needle engaging member includes a body member and a plurality of openings formed in the body member, the number of the plurality of openings being equal to the number of the plurality of needles, each of the plurality of openings being positioned to underlie a corresponding one of the plurality of needles of the needle carrying member so that the plurality of openings matingly receive the plurality of needles as the plurality of needles pass into and out of the plurality of openings to thereby engage the needles and sliver being carried therewith.

16. An apparatus as defined in claim 15, wherein the body member of the needle engaging member includes a substantially closed bottom, and wherein the bottom underlies each of the plurality of openings so that portions of the bottom define a floor for each of the plurality of openings.

17. An apparatus as defined in claim 11, wherein the needle carrying member is detachably connected to the first handle portion and defines a needle cartridge to readily remove from the first handle portion.

18. An apparatus as defined in claim 17, further comprising at least one replacement auxiliary needle cartridge adapted to be readily positioned in the first handle portion.

19. An apparatus for splicing sliver, the apparatus comprising:

a first handle portion having at least one sliver engaging member, the at least one sliver engaging member including a plurality of needles;

a second handle portion positioned to receive the at least one sliver engaging member in a closed position, the first and second handle portions in combination defining a hand-activated needle actuation device;

a pivot member associated with the first and second handle portions to allow either the first or second handle portions to pivot about the pivot member between respective open and closed positions, the open position being defined by portions of the first handle member having the at least one sliver engaging member being spaced-apart from portions of the second handle portion positioned to receive the at least one sliver engaging member and the closed position being defined by the at least one sliver engaging member of the first handle portion being received by the portions of the second handle member when positioned closely adjacent thereto, the hand-activated needle actuation device being responsive to grippingly closing at least portions of the hand of a user to actuate the engaging of the plurality of needles with the sliver to be spliced and the portions of the second handle portion when the sliver is positioned between the plurality of needles and the portions of the second handle portion so that the engaging of plurality of needles with the portions of the second handle portion thereby further defines the closed position; and a biasing member associated with the pivot member and positioned to bias either the first or the second handle portions in a preselected biased position.

20. An apparatus as defined in claim 19, wherein the biasing member is connected to the pivot member and positioned to bias the first handle portion in the open position.

21. An apparatus as defined in claim 20, wherein each of the plurality of needles includes a needle body and a recessed portion formed in the needle body and positioned to assist in the engaging of and interconnecting of the sliver when each needle engages sliver during movement to the closed position.

22. An apparatus as defined in claim 21, wherein the recessed portion includes at least one of the following: a barb, a groove, and a channel.

23. An apparatus as defined in claim 19, wherein the at least one sliver engaging member is detachably connected to the first handle portion and defines a cartridge member to readily remove from the first handle portion.

24. An apparatus as defined in claim 23, further comprising at least one replacement auxiliary cartridge member adapted to be readily positioned in the first handle portion.

25. An apparatus as defined in claim 19, further comprising a lock associated with the first and second handle portions to lock the first and second handle portions in a closed position.

26. An apparatus for splicing sliver, the apparatus comprising:

a first handle portion having a handle body and at least one sliver engaging member detachably connected to the handle body to thereby define a cartridge member;

a second handle portion pivotally connected to and positioned to receive the at least one sliver engaging member and pivot between open and closed positions, the open position being defined by the at least one sliver engaging member being spaced-apart from portions of the second handle portion positioned to receive the at least one sliver engaging member and the closed position being defined by the at least one sliver engaging member of the first handle portion being received by the portions of the second handle portion when positioned closely adjacent thereto; and a biasing member positioned to bias either the first or the second handle portions in a preselected biased position.

27. An apparatus as defined in claim 26, wherein the first handle portion is biased by the biasing member to the open position.

28. An apparatus as defined in claim 27, wherein the first and second handle portions define a hand-activated needle actuation device, wherein the at least one sliver engaging member includes a plurality of needles, and wherein the hand-activated needle actuation device is responsive to grippingly closing at least portions of the hand of a user to actuate the engaging of the plurality of needles with sliver to be spliced and the portions of the second handle portion when the sliver is positioned between the plurality of needles and the portions of the second handle portion so that the engaging of plurality of needles with the portions of the second handle portion thereby further defines the closed position.

29. An apparatus as defined in claim 28, wherein each of the plurality of needles includes a needle body and a recessed portion formed in the needle body and positioned to assist in the engaging of and interconnecting of the sliver when each needle engages sliver during movement to the closed position.

30. An apparatus as defined in claim 29, wherein the recessed portion includes at least one of the following: a barb, a groove, and a channel.

31. An apparatus as defined in claim 26, further comprising at least one replacement auxiliary cartridge member adapted to be readily positioned in the first handle portion.

32. An apparatus as defined in claim 26, further comprising a lock associated with the first and second handle portions to lock the first and second handle portions in a closed position.

33. A method of splicing sliver, the method comprising:

joining first portions of sliver with a plurality of needles each having a recessed portion to engage and intertwine with adjacent second portions of sliver, the plurality of needles being connected to a body portion so that the body portion and the plurality of needles in combination define a needle cartridge member; and replacing the needle cartridge member with an auxiliary cartridge member also having a body portion and a plurality of needles connected to the body portion.

34. An apparatus for splicing sliver, the apparatus comprising:

a first handle portion having at least one sliver engaging member;

a second handle portion positioned to receive the at least one sliver engaging member in a closed position;

a pivot member associated with the first and second handle portions to allow either the first or second handle portions to pivot about the pivot member between respective open and closed positions, the open position being defined by portions of the first handle member having the at least one sliver engaging member being spaced-apart from portions of the second handle portion positioned to receive the at least one sliver engaging member and the closed position being defined by the at least one sliver engaging member of the first handle portion being received by the portions of the second handle member when positioned closely adjacent thereto; and a biasing member connected to the pivot member and positioned to bias the first handle portions in an open.

35. An apparatus as defined in claim 34, wherein each of the plurality of needles includes a needle body and a recessed portion formed in the needle body and positioned to assist in the engaging of and interconnecting of the sliver when each needle engages sliver during movement to the closed position.

36. An apparatus for splicing sliver, the apparatus comprising:

a first handle portion having at least one sliver engaging member, the at least one sliver engaging member being detachably connected to the first handle portion and defining a cartridge member to readily be removed from the first handle portion;

a second handle portion positioned to receive the at least one sliver engaging member in a closed position;

a pivot member associated with the first and second handle portions to allow either the first or second handle portions to pivot about the pivot member between respective open and closed positions, the open position being defined by portions of the first handle member having the at least one sliver engaging member being spaced-apart from portions of the second handle portion positioned to receive the at least one sliver engaging member and the closed position being defined by the at least one sliver engaging member of the first handle portion being received by the portions of the second handle member when positioned closely adjacent thereto; and a biasing member associated with the pivot member and positioned to bias either the first or the second handle portions in a preselected biased position.

37. An apparatus as defined in claim 36, further comprising at least one replacement auxiliary cartridge member adapted to be readily positioned in the first handle portion.

* * * * *

UNITED STATES PATENT AND TRADEMARK OFFICE

CERTIFICATE OF CORRECTION

PATENT NO. : 6,360,519 B1
DATED : March 26, 2002
INVENTOR(S) : Donald Lynn Hoover It is certified that error appears in the above-identified patent and that said Letters Patent is hereby corrected as shown below:

Title page,
Item [54], please delete "SILVERS" and insert -- SLIVERS -- therefore.

Signed and Sealed this

First Day of October, 2002

*Attest:*

*Attesting Officer*

JAMES E. ROGAN
*Director of the United States Patent and Trademark Office*